US007792310B2

(12) United States Patent
Lee et al.

(10) Patent No.: US 7,792,310 B2
(45) Date of Patent: Sep. 7, 2010

(54) METHOD AND APPARATUS FOR AUTOMATICALLY SETTING SPEAKER MODE IN AUDIO/VIDEO SYSTEM

(75) Inventors: Jae-cheol Lee, Suwon-si (KR); Hae-kwang Park, Seoul (KR); Jong-bae Kim, Seoul (KR)

(73) Assignee: Samsung Electronics Co., Ltd., Suwan-Si (KR)

( * ) Notice: Subject to any disclaimer, the term of this patent is extended or adjusted under 35 U.S.C. 154(b) by 1407 days.

(21) Appl. No.: 11/214,722

(22) Filed: Aug. 31, 2005

(65) Prior Publication Data

US 2006/0104453 A1 May 18, 2006

(30) Foreign Application Priority Data

Nov. 16, 2004 (KR) ..... 10-2004-0093543

(51) Int. Cl.
*H04R 29/00* (2006.01)

(52) U.S. Cl. ..... 381/59; 700/94

(58) Field of Classification Search ..... 381/58, 381/59, 1, 98, 103, 16, 150, 182, 120, 104, 381/107, 111, 117, 96, 55; 700/94
See application file for complete search history.

(56) References Cited

U.S. PATENT DOCUMENTS 6,359,987 B1 * 3/2002 Tran et al. ..... 381/58
2004/0080440 A1 4/2004 Su et al.

FOREIGN PATENT DOCUMENTS

| | | | |
|---|---|---|---|
| JP | 11-122700 | A | 4/1999 |
| JP | 2000-023300 | * | 1/2000 |
| JP | 2000-023300 | A | 1/2000 |
| KR | 90-11329 | A | 7/1990 |
| KR | 95-7596 | A | 3/1995 |
| KR | 1998-037014 | A | 8/1998 |
| KR | 1998-0038622 | A | 8/1998 |
| KR | 0171839 | B1 | 10/1998 |
| KR | 2000-0009501 | A | 2/2000 |
| KR | 10-0288064 | B1 | 2/2001 |
| KR | 20-0353279 | Y1 | 6/2004 |

* cited by examiner

*Primary Examiner*—Vivian Chin
*Assistant Examiner*—Lun-See Lao
(74) *Attorney, Agent, or Firm*—Sughrue Mion, PLLC

(57) ABSTRACT

A method and apparatus for automatically determining a characteristic of a speaker and automatically setting a speaker mode in an audio/video system. The method includes: detecting a current for operating the speaker by inputting a predetermined signal; measuring an impedance characteristic of the speaker in accordance with a frequency change based on the detected current; determining a speaker type based on the measured impedance characteristic; and setting a speaker mode based on an impedance characteristic curve of the discriminated speaker type.

7 Claims, 5 Drawing Sheets

METHOD AND APPARATUS FOR AUTOMATICALLY SETTING SPEAKER MODE IN AUDIO/VIDEO SYSTEM

CROSS-REFERENCE TO RELATED PATENT APPLICATIONS

This application claims the benefit of Korean Patent Application No. 10-2004-0093543, filed on Nov. 16, 2004, in the Korean Intellectual Property Office, the disclosure of which is incorporated herein in its entirety by reference.

BACKGROUND OF THE INVENTION

1. Field of the Invention

The present invention relates to a home theater system, and more particularly, to a method and apparatus for automatically determining a characteristic of a speaker and automatically setting a speaker mode in an audio/video system.

2. Description of the Related Art

Commonly, a home theater system includes a 5.1 channel amplifier, a digital versatile disc (DVD) playback device, and a tuner, and is used with a large screen digital TV. Also, the home theater system can not only realize high image quality by adopting a progressive scanning function, which is an up-to-date image technology, but can also reproduce 2-channel stereo sound signals from, for example, a video cassette recorder (VCR) or a TV broadcastast, as 5.1 channel sound, using Dolby pro-logic decoding technology.

In such a home theater system, a user should manually set speaker modes based on the number of speakers and reproducing frequency bands of the speakers.

FIG. 1 is a signaling diagram of a conventional digital signal processor for setting speaker modes in a conventional 5.1 channel speaker system.

Referring to FIG. 1, input audio signals of 5.1 channels, such as front, center, surround, surround back, and low frequency effect (LFE) channels, are output to corresponding speakers, respectively. Here, the user sets speaker modes by selecting keys mounted on a remote control or a front panel. The speaker modes are "large", "small", and "none", and the user directly selects one of these speaker modes based on types of the speakers and the number of the speakers. In the "large" speaker mode, all of audio signals in an acoustic frequency band (20 Hz to 20 KHz) are output. In the "small" speaker mode, signals in a mid-to-high frequency band are output, and signals in a low frequency band are output separately to a subwoofer or another speaker. In the "none" speaker mode, no signal is output.

Thus, when speaker modes are set according to user selection, the digital signal processor first determines whether to pass signals through low pass filters (LPFs) or through high pass filters (HPFs) and how to combine the signals, based on the set speaker modes, then processes sound output from a sound reproducer to correspond with each speaker mode, and outputs the processed sound to corresponding speakers.

However, since the user is responsible for setting speaker modes in this conventional speaker mode setting method, it is difficult to operate a plurality of speakers, and it is troublesome to separately determine the settings of the plurality of speakers. Also, since the setting of speaker modes is dependent upon a user's familiarity with the characteristics of the speakers, there is a high possibility of inaccurately setting the reproducible frequency range of speakers. Accordingly, it is difficult to obtain an optimal sound effect. Also, if the speaker mode of large or small includes an unconnected speaker, the listener will not be able to hear sounds that are designated to be played by the unconnected speaker.

SUMMARY OF THE INVENTION

The present invention provides a method of automatically determining characteristics of speakers and automatically setting speaker modes in a system.

The present invention also provides an apparatus for automatically determining characteristics of speakers and automatically setting speaker modes in a system.

According to an aspect of the present invention, there is provided a method of automatically setting a speaker mode by which a pattern of a signal output to a speaker is determined, the method comprising: detecting a current for operating the speaker by inputting a predetermined signal; measuring an impedance characteristic of the speaker in accordance with a frequency change based on the detected current; discriminating a speaker type based on the measured impedance characteristic; and setting a speaker mode based on an impedance characteristic curve of the discriminated speaker type.

According to another aspect of the present invention, there is provided an apparatus for automatically setting a speaker mode in a multi-channel speaker system, the apparatus comprising: a speaker; a power supply supplying power; an amplifier amplifying a signal; a current detector detecting a current output from the amplifier to the speaker or from the power supply to the amplifier; and a digital signal processor outputting a broadband signal including a low frequency to the amplifier, measuring an impedance characteristic of the speaker based on the current detected by the current detector, discriminating a speaker type based on the measured impedance characteristic, and setting a speaker mode based on an impedance characteristic curve of the discriminated speaker type.

According to another aspect of the present invention, there is provided a multi-channel audio/video system comprising: a digital signal processor generating a predetermined signal, detecting a current value in accordance with a frequency change of the signal, measuring an impedance characteristic of a speaker in accordance with the frequency change based on the detected current value, discriminating a speaker type based on the measured impedance characteristic, and setting a speaker mode based on an impedance characteristic curve of the discriminated speaker type; and a microprocessor receiving the set speaker mode data from the digital signal processor and controlling whether to pass a signal through a filter and a combination of channels based on the set speaker mode data.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which embodiments of the invention are shown.

Figure 1:
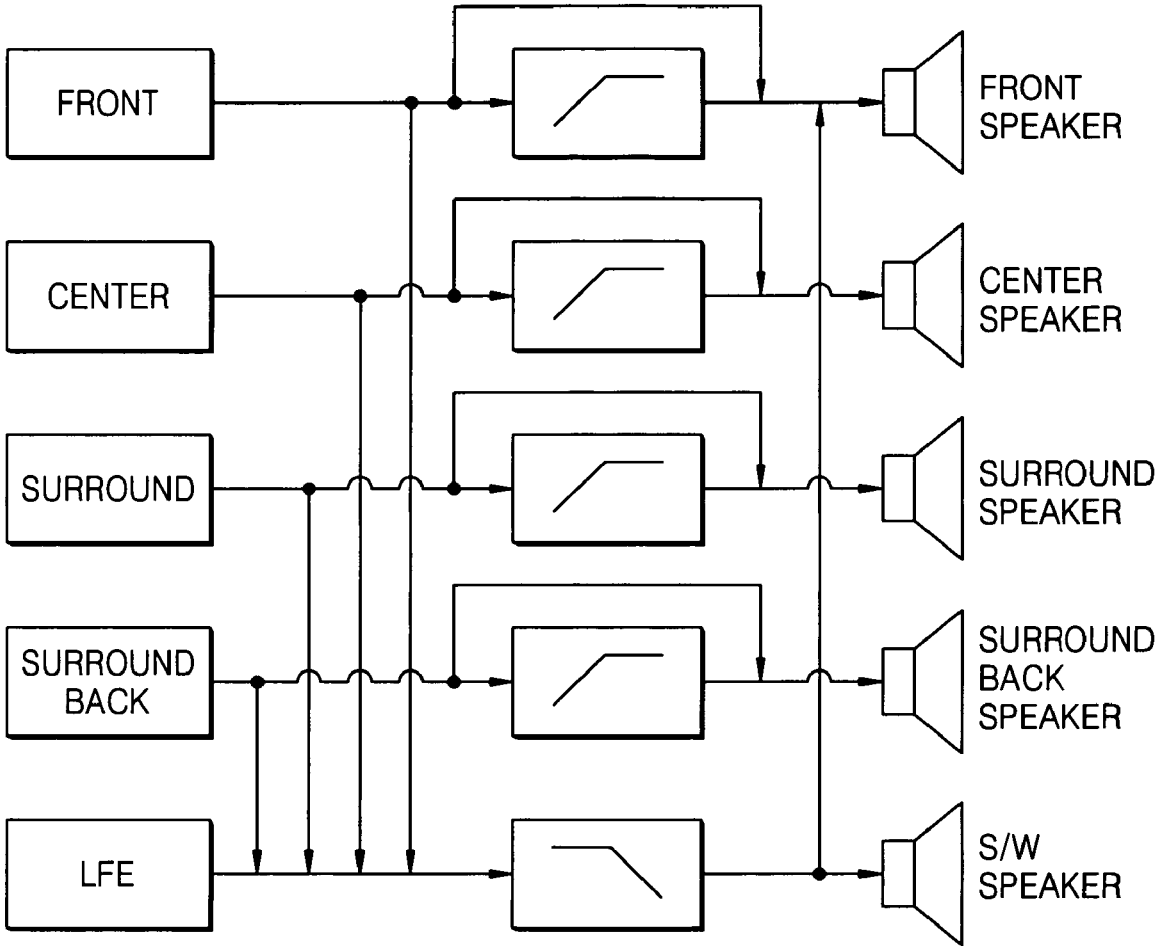
FIG. 1 (PRIOR ART)
FIG. 1 is a signaling diagram of a conventional digital signal processor for setting speaker modes in a conventional 5.1 channel speaker system.
Figure 2:
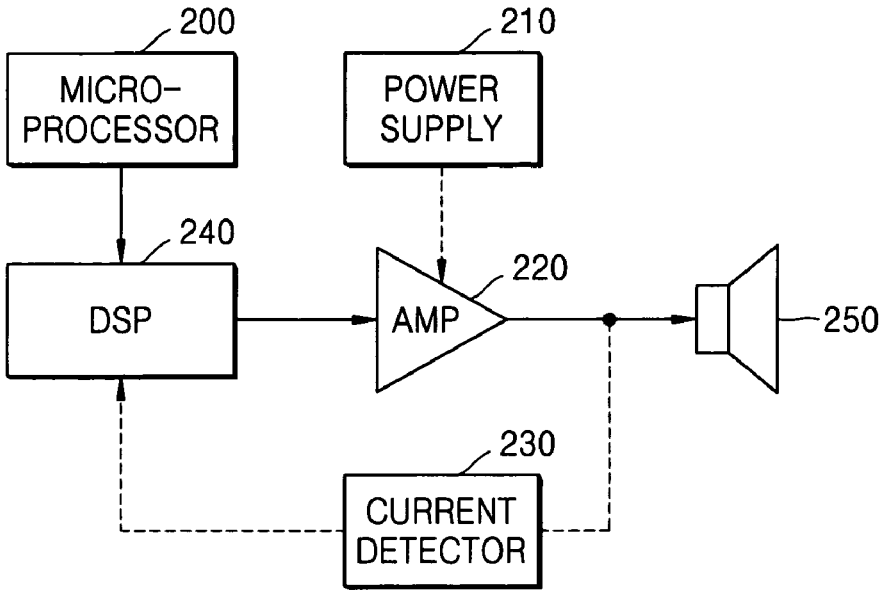
FIG. 2 is a block diagram of a system for automatically setting speaker modes according to a first exemplary embodiment of the present invention.

FIG. 2 is a block diagram of a system for automatically setting speaker modes according to a first embodiment of the present invention.

Referring to FIG. 2, the system includes a microprocessor 200, a power supply 210, an amplifier 220, a current detector 230, a digital signal processor (DSP) 240, and a speaker 250.

The microprocessor 200 generates a speaker mode setting command. The power supply 210 supplies power to the amplifier 220 and the other blocks.

The current detector 230 detects the amount of current output from the amplifier 220 to the speaker 250. The current detector 230 can sense the current for operating the speaker 250 by using a current sensing component such as a resistor R.

The DSP 240 receives the speaker mode setting command from the microprocessor 200, outputs a broadband test signal including a low frequency to the amplifier 220, measures an impedance characteristic of the speaker 250 based on the current detected by the current detector 230, discriminates a speaker type (a duct-type speaker or a sealed-type speaker) based on the measured impedance characteristic, and sets a speaker mode (large, small, or none) for determining a signal pattern output to a corresponding speaker based on an impedance characteristic curve of the discriminated speaker type. Also, the DSP 240 controls passage of a signal through a low pass filter (LPF) or a high pass filter (HPF) and combination of multi-channel signals, based on the set speaker mode.

The amplifier 220 amplifies the test signal output from the DSP 240 and outputs the amplified signal to the speaker 250.

In another embodiment, the microprocessor 200 receives speaker mode setting data from the DSP 240 and controls whether to pass a signal through a LPF or a HPF and how to combine multi-channel signals, based on the received speaker mode setting data.

Figure 3:
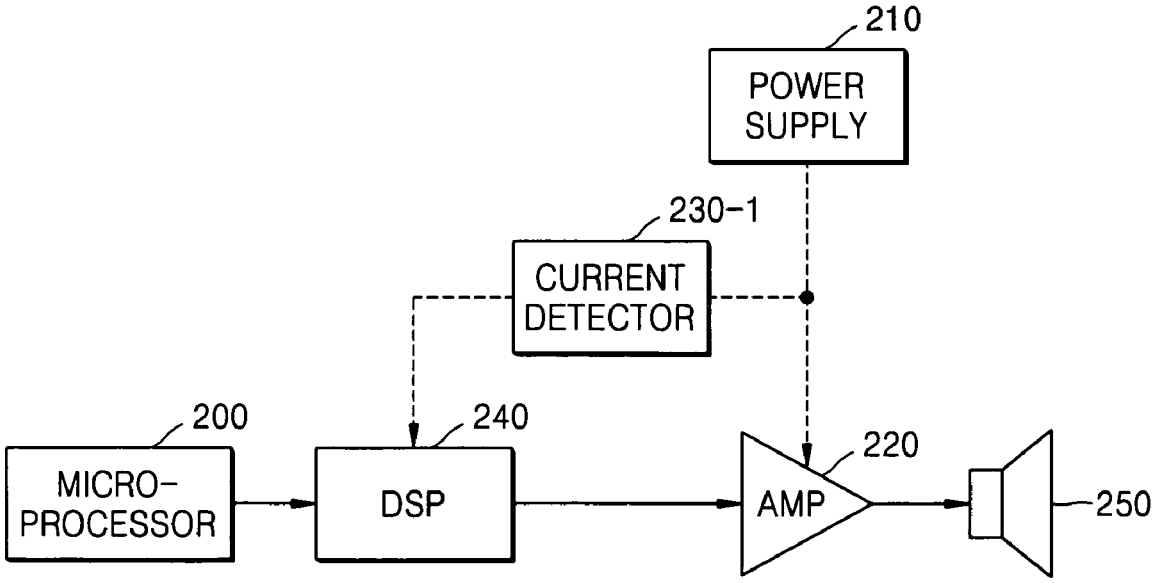
FIG. 3 is a block diagram of a system for automatically setting speaker modes according to a second exemplary embodiment of the present invention.

FIG. 3 is a block diagram of a system for automatically setting a speaker mode according to a second exemplary embodiment of the present invention.

Referring to FIG. 3, a current detector 230-1 detects a current supplied from the power supply 210 to the amplifier 220. Here, the microprocessor 200, the power supply 210, the amplifier 220, the DSP 240 and the speaker 250 are the same as in FIG. 2; only the current detector 230-1 is different.

FIGS. 4 through 7 are waveform diagrams illustrating frequency vs. impedance of duct-type and sealed-type speakers.

Referring to FIGS. 4 through 7, for the duct-type speaker, two peak components are generated in a low frequency band, and a dip component is generated between the two peak components. An adjacent frequency of the dip component represents −3 dB corresponding to a low threshold frequency of the duct-type speaker. For the sealed-type speaker, one peak component is generated in the low frequency band. An adjacent frequency of the peak component represents −3 dB corresponding to a low threshold frequency of the sealed-type speaker.

Figure 4:
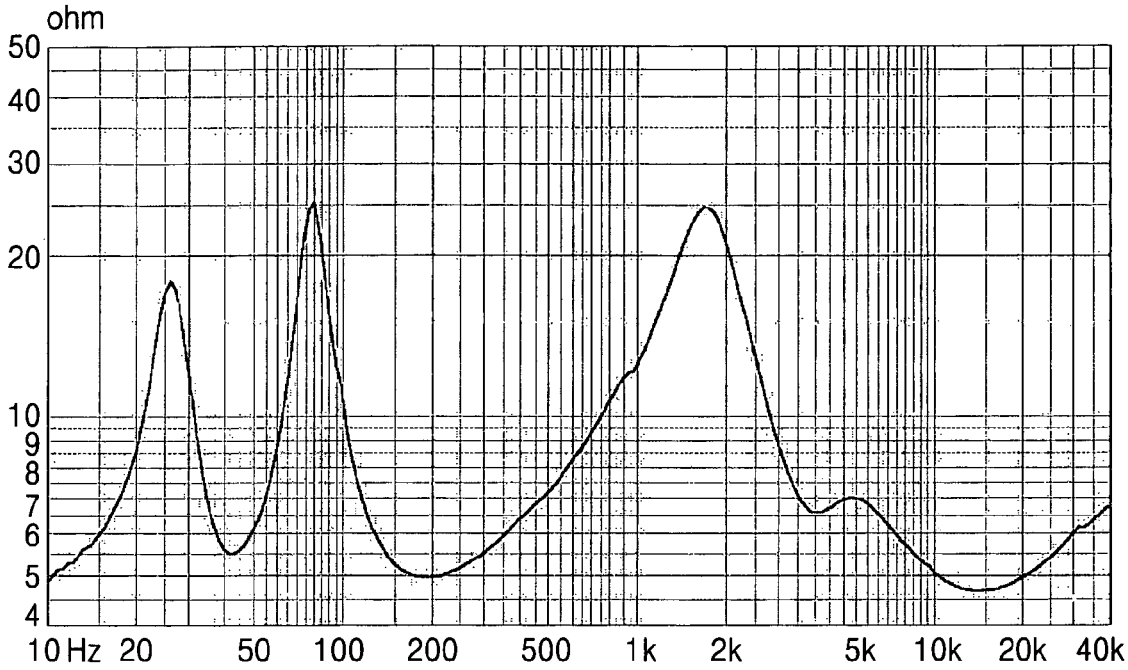
FIG. 4 is a waveform diagram illustrating frequency vs. impedance of a duct-type speaker that enables reproduction of low band signals.

Referring to FIG. 4, since two peak components and a dip component are generated in the low frequency band, it can be determined that it is the waveform diagram of a duct-type speaker. Also, since the frequency of the dip component is around 40 Hz, it can be determined that the duct-type speaker can reproduce frequencies in the low band. In this case, the speaker mode is set to large.

Figure 5:
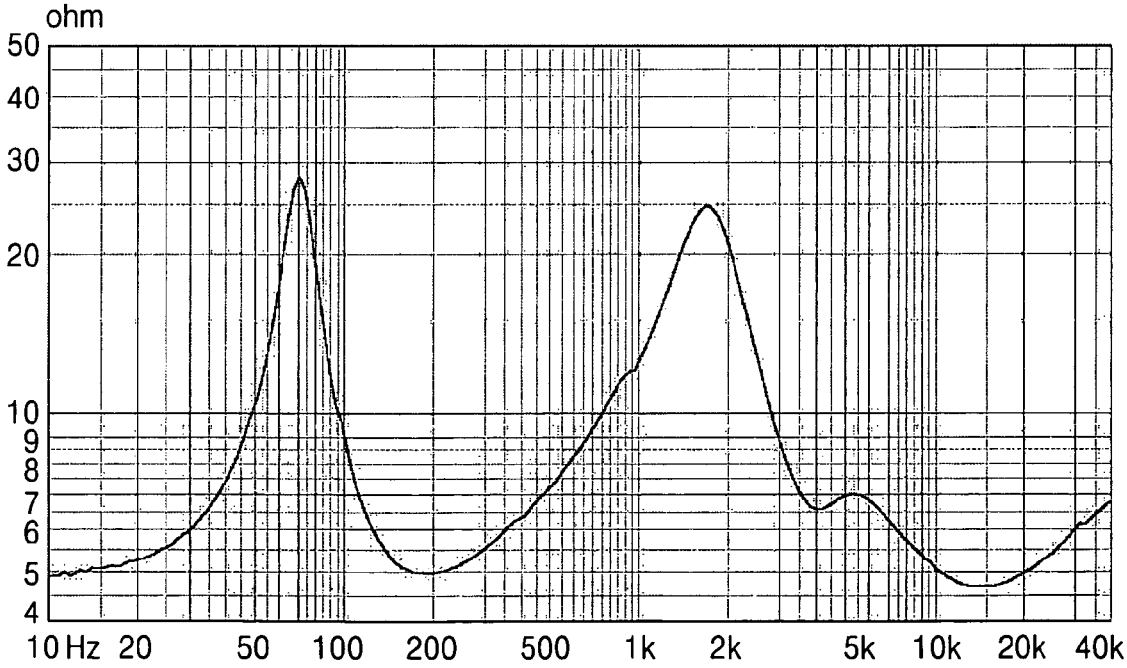
FIG. 5 is a waveform diagram illustrating frequency vs. impedance of a sealed-type speaker that enables reproduction of low band signals.

Referring to FIG. 5, since only one peak component is generated in the low frequency band, it can be determined that it is the waveform diagram of sealed-type speaker. Also, since the frequency of the peak component is around 80 Hz, it can be determined that the sealed-type speaker can reproduce frequencies in the low band. In this case, the speaker mode is set to large.

Figure 6:
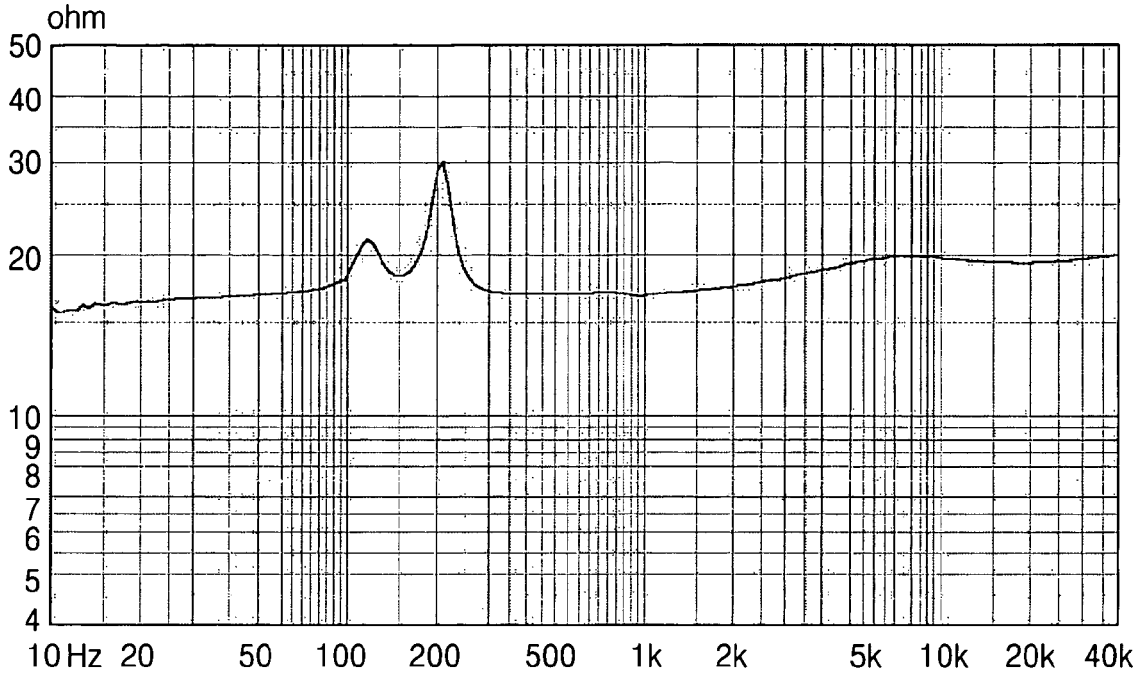
FIG. 6 is a waveform diagram illustrating frequency vs. impedance of a duct-type speaker in which it is difficult to produce low band signals.

Referring to FIG. 6, since two peak components and a dip component are generated in the low frequency band, it can be determined that it is the waveform diagram of a duct-type speaker. Also, since the frequency of the dip component is around 150 Hz, it can be determined that it is difficult for the duct-type speaker to reproduce frequencies in the low band. In this case, the speaker mode is set to small.

Figure 7:
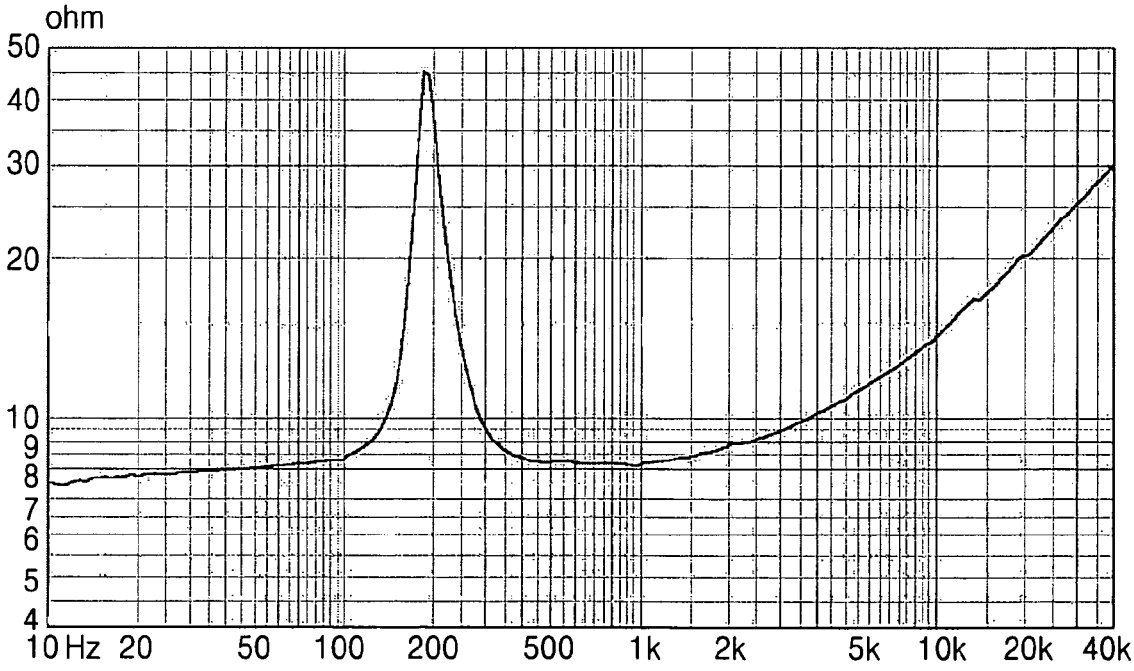
FIG. 7 is a waveform diagram illustrating frequency vs. impedance of a sealed-type speaker in which it is difficult to produce low band signals.

Referring to FIG. 7, since only one peak component is generated in the low frequency band, it can be determined that it is the waveform diagram of a sealed-type speaker. Also, since the frequency of the peak component is around 200 Hz, it can be determined that it is difficult for the sealed-type speaker to reproduce frequencies in the low band. In this case, the speaker mode is set to small.

Figure 8:
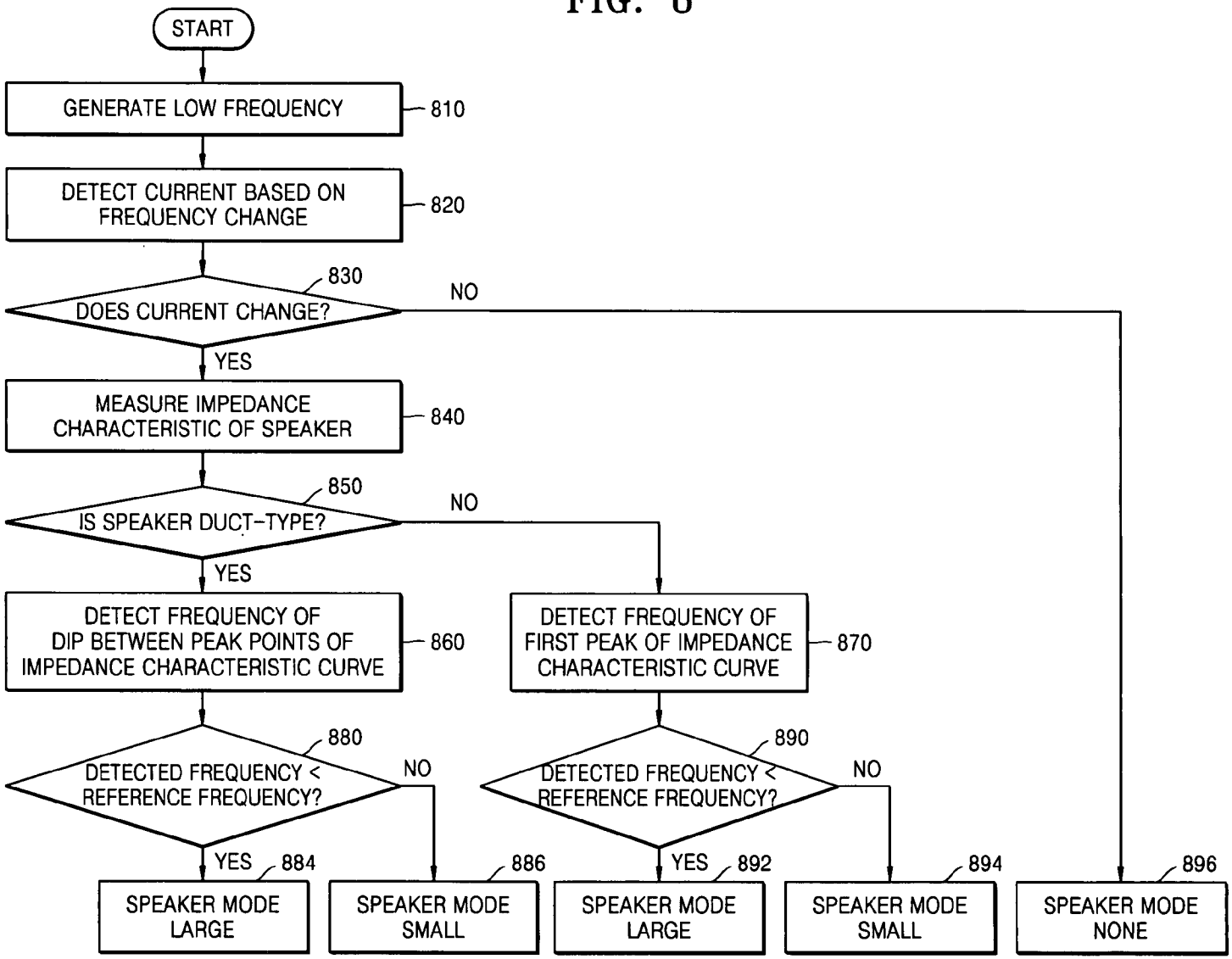
FIG. 8 is a flowchart illustrating a method of automatically setting speaker modes according to an exemplary embodiment of the present invention.

FIG. 8 is a flowchart illustrating a method of automatically setting speaker modes according to an exemplary embodiment of the present invention.

In operation 810, when a speaker mode setting command is received from the microprocessor 200, the DSP 240 generates a broadband test signal including low frequencies, such as white noise or impulse noise.

In operation 820, the current detector 230 detects a current I flowing from the amplifier 220 to the speaker 250 or the power supply 210 to the amplifier 220 based on a frequency change of the test signal of operation 810.

In operation 830, the DSP 240 determines through the current detector 230 whether the current I flowing from the amplifier 220 to the speaker 250 or the power supply 210 to the amplifier 220 changed. If the current detector 230 cannot detect a current change, in operation 896, the DSP 240 determines that there is no corresponding speaker and sets the speaker mode to none.

If the current detector 230 detects a current change, in operation 840, the DSP 240 measures an impedance characteristic in accordance with a frequency based on the current. For example, an impedance Z is measured using the voltage V and current I of the low frequency.

In operation 850, the DSP 240 discriminates a corresponding speaker type, either as a duct-type or a sealed-type, based on the measured impedance characteristic. That is, since two peak components and a dip component are detected in the low frequency band according to the impedance characteristics of FIGS. 4 and 6, the DSP 240 determines that the speaker is a duct-type speaker, and since one peak component is detected in the low frequency band according to the impedance characteristics of FIGS. 5 and 7, the DSP 240 determines that the speaker is a sealed-type speaker.

Thus, if the DSP 240 determines that the measured impedance characteristic corresponds to the duct-type speaker, in operation 860, the DSP 240 detects a frequency of a dip between peak points of an impedance characteristic curve. If the detected dip frequency is lower than a reference frequency, it is determined that low band reproduction is possible, and in operation 884, the speaker mode is set to large. If the detected dip frequency is higher than the reference frequency, it is determined that low band reproduction is difficult, and in operation 886, the speaker mode is set to small. For example, in FIG. 4, since the dip frequency (40 Hz) is lower than the reference frequency (100 Hz), the speaker mode is set to large, and low band reproduction is possible. Also, in FIG. 6, the dip frequency (150 Hz) is higher than the reference frequency (100 Hz), and the speaker mode is set to small and low band reproduction is difficult.

If the DSP 240 determines that the measured impedance characteristic corresponds to the sealed-type speaker, in operation 870, the DSP 240 detects the frequency of a first peak of an impedance characteristic curve. Here, if the detected peak frequency is lower than the reference frequency, since low band reproduction is possible, in operation 892, the speaker mode is set to large. If the detected peak frequency is higher than the reference frequency, since low band reproduction is difficult, in operation 894, the speaker mode is set to small. For example, in FIG. 5, since the peak frequency (80 Hz) is lower than the reference frequency (100 Hz), the speaker mode is set to large and low band reproduction is possible. Also, in FIG. 7, the peak frequency (200 Hz) is higher than the reference frequency (100 Hz), and the speaker mode is set to small since low band reproduction is difficult.

Finally, the DSP 240 outputs sound to each corresponding speaker by controlling whether to pass signals through an LPF or through an HPF and how to combine multi-channel signals, based on a speaker mode automatically set for each of multi-channel speakers.

The exemplary embodiments of the present invention can be written as computer programs and stored on computer-readable recording media. Examples of the computer-readable recording media include magnetic storage media (e.g., ROM, floppy disks, hard disks, etc.), optical recording media (e.g., CD-ROMs, DVDs, etc.), and storage media such as carrier waves (e.g., transmission over the Internet). The computer readable recording media can also be distributed over a network of coupled computer systems so that the computer-readable code is stored and executed in a decentralized fashion.

As described above, according to exemplary embodiments of the present invention, by automatically setting a speaker mode using a change in current flowing to a speaker in a multi-channel speaker system, convenience is provided to a user who is not familiar with setting speaker modes, and optimal sound can be reproduced by preventing the user from making mistakes in setting speaker modes.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of automatically setting a speaker mode by which a pattern of a signal output to a speaker is determined, the method comprising:

detecting a current for operating the speaker by inputting a predetermined signal;

measuring an impedance characteristic of the speaker in accordance with a frequency change based on the detected current;

determining a speaker type based on a peak component and a dip component in a low frequency band of the measured impedance characteristic; and setting the speaker mode based on an impedance characteristic curve of the determined speaker type;

wherein in determining the speaker type, if two peak components and one dip component between the two peak components exist in the low frequency band of the impedance characteristic curve, it is determined that the speaker is a duct-type speaker; and if one peak component exists in the low frequency band of the impedance characteristic curve, it is determined that the speaker is a sealed-type speaker.

2. The method of claim 1, wherein the detected current is current flowing from an amplifier to the speaker.

3. The method of claim 1, wherein the detected current is current flowing from a power supply to the amplifier.

4. The method of claim 1, further comprising:

if no current change is detected, determining that a corresponding speaker does not exist and outputting no signal.

5. The method of claim 1, wherein in the setting of the speaker mode, if a frequency of the dip component between the peak components of the impedance characteristic curve is lower than a reference frequency, a mode of outputting a signal of an acoustic frequency band is determined; and if a frequency of the peak component of the impedance characteristic curve is higher than the reference frequency, a mode of outputting a signal of a mid-to-high band (excluding a low band) is determined.

6. A method of automatically setting a speaker mode by which a pattern of a signal output to a speaker is determined, the method comprising:

detecting a current for operating the speaker by inputting a predetermined signal;

measuring an impedance characteristic of the speaker in accordance with a frequency change based on the detected current;

determining a speaker type based on a peak component and a dip component in a low frequency band of the measured impedance characteristic; and setting the speaker mode based on an impedance characteristic curve of the determined speaker type;

wherein in the setting of the speaker mode, if it is determined that the speaker is a duct-type speaker, a frequency of the dip component between the peak components of the impedance characteristic curve is detected; and if it is determined that the speaker is a sealed-type speaker, a frequency of the peak components of the impedance characteristic curve is detected.

7. An apparatus for automatically setting a speaker mode in a multi-channel speaker system, the apparatus comprising:

a speaker;

a power supply configured to supply power;

an amplifier configured to amplify a signal;

a current detector configured to detect a current output one of from the amplifier to the speaker and from the power supply to the amplifier; and a digital signal processor configured to output a broadband signal including a low frequency to the amplifier, measure an impedance characteristic of the speaker based on the current detected by the current detector, determining a speaker type based on peak component and dip component in a low frequency band of the measured impedance characteristic, and a speaker mode based on an impedance characteristic curve of the determined speaker type;

wherein the digital signal processor comprises:

means for generating a broadband signal including the low frequency;

means for measuring the impedance characteristic in accordance with a frequency based on the current detected by the current detector;

means for determining a duct-type speaker from a sealed-type speaker based on the measured impedance characteristic;

means for detecting a frequency of a dip component between peak components of the impedance characteristic curve if the speaker is the duct-type speaker and detecting a frequency of the peak component of the impedance characteristic curve if the speaker is a sealed-type speaker; and means for setting a speaker mode by comparing one of the detected dip and peak frequency to a reference frequency.

* * * * *